US009125440B1

(12) United States Patent
Guerrero

(10) Patent No.: US 9,125,440 B1
(45) Date of Patent: Sep. 8, 2015

(54) WIDEFLY TROUSERS

(71) Applicant: Lee J. Guerrero, Pueblo, CO (US)

(72) Inventor: Lee J. Guerrero, Pueblo, CO (US)

( * ) Notice: Subject to any disclaimer, the term of this patent is extended or adjusted under 35 U.S.C. 154(b) by 0 days.

(21) Appl. No.: 13/761,065

(22) Filed: Feb. 6, 2013

Related U.S. Application Data

(63) Continuation-in-part of application No. 13/724,972, filed on Dec. 21, 2012, now abandoned.

(51) Int. Cl.

| | |
|---|---|
| ***A41D 1/06*** | (2006.01) |
| ***A41D 13/02*** | (2006.01) |
| ***A41F 9/00*** | (2006.01) |
| ***A41F 9/02*** | (2006.01) |
| *A41D 13/00* | (2006.01) |

(52) U.S. Cl.
CPC ... *A41D 1/06* (2013.01); *A41F 9/02* (2013.01); *A41D 13/0012* (2013.01)

(58) Field of Classification Search
CPC ..... A41F 9/00; A41F 9/02; A41F 9/025; A41D 1/06; A41D 1/065; A41D 13/05; A41D 13/1254; A41D 1/088; A41D 13/0012; A41D 13/0525; A41D 13/0537
USPC ..... 2/79, 234, 227, 235, 236, 237, 408, 2/78.2, 229, 300
See application file for complete search history.

(56) References Cited

U.S. PATENT DOCUMENTS

| | | | | | |
|---|---|---|---|---|---|
| 498,951 | A | * | 6/1893 | Birnbaum | 2/237 |
| 1,074,109 | A | * | 9/1913 | Eschelbacher | 2/219 |
| 1,128,824 | A | * | 2/1915 | Struck | 2/235 |
| 2,334,144 | A | * | 11/1943 | Bono | 2/235 |
| 3,246,342 | A | * | 4/1966 | Pagano | 2/227 |
| RE26,360 | E | * | 3/1968 | Pagano | 450/95 |
| 3,537,108 | A | * | 11/1970 | Daniels | 2/252 |
| 4,006,494 | A | * | 2/1977 | Knoppel | 2/227 |
| 4,164,044 | A | * | 8/1979 | Holmes | 2/237 |
| 4,215,685 | A | * | 8/1980 | Ibel | 602/67 |
| 4,389,733 | A | * | 6/1983 | Boykins, Jr. | 2/466 |
| 4,580,298 | A | * | 4/1986 | Tuisl | 2/237 |
| 4,604,761 | A | * | 8/1986 | Wright | 2/227 |

(Continued)

FOREIGN PATENT DOCUMENTS

| | | | | |
|---|---|---|---|---|
| FR | 1189001 | A * | 9/1959 | |
| FR | 2648325 | A1 * | 12/1990 | A41D 1/06 |

OTHER PUBLICATIONS

English machine translation of "FR 2648325 A1" via Espacenet.com.*

*Primary Examiner* — Alissa L Hoey
*Assistant Examiner* — Jameson Collier
(74) *Attorney, Agent, or Firm* — Plager Schack LLP

(57) ABSTRACT

Trousers provide more comfort for a user than traditional pants. The trousers comprise widefly jeans mechanically coupled to an adjustable waistband fastened by four riveted buttons. The adjustable waistband is mechanically coupled to a quick release front flap by a hook and loop fastener. The quick release front flap travels from the adjustable waistband to an area behind a user's scrotum. The user can easily open and close the widefly jeans with a single hand by simply uncoupling the adjustable waistband from the widefly jeans and removing the front flap by uncoupling the hook and loop fastener. This enables the user to access an inside of widefly jeans with the single hand and to urinate or without removing the trousers. Additionally, pockets are affixed to the widefly jeans that are partially removable with a hook and loop fastener and can store a wallet or armor or a GPS.

4 Claims, 4 Drawing Sheets

(56) References Cited

U.S. PATENT DOCUMENTS

| | | | | | |
|---|---|---|---|---|---|
| 4,803,740 | A * | 2/1989 | Dawson | 2/215 |
| 5,008,962 | A * | 4/1991 | Smith et al. | 2/234 |
| 5,010,595 | A * | 4/1991 | Stradley | 2/227 |
| 5,163,184 | A * | 11/1992 | Reardon | 2/237 |
| 5,678,250 | A * | 10/1997 | Nolan | 2/227 |
| 5,867,836 | A * | 2/1999 | Quinones | 2/236 |
| 5,926,851 | A * | 7/1999 | Kovalik | 2/227 |
| 6,219,848 | B1 * | 4/2001 | Russell | 2/221 |
| 7,716,755 | B1 * | 5/2010 | Wiens | 2/466 |
| 2009/0158502 | A1 * | 6/2009 | Medolla et al. | 2/227 |
| 2009/0282600 | A1 * | 11/2009 | Robinson | 2/79 |
| 2013/0074251 | A1 * | 3/2013 | Crye et al. | 2/466 |
| 2013/0212779 | A1 * | 8/2013 | Dowling et al. | 2/243.1 |
| 2014/0230130 | A1 * | 8/2014 | Edwards | 2/227 |

* cited by examiner

WIDEFLY TROUSERS

CROSS REFERENCE TO RELATED APPLICATIONS

This application is a continuation-in-part of U.S. Non-Provisional patent application Ser. No. 13/724,972 filed on Dec. 21, 2012 which is incorporated by reference.

FIELD OF THE INVENTION

This invention relates to bifurcated nether garments of the type usually worn by men and boys as outer garments. This includes devices having means for closing and securing the waistbands of trousers or overalls.

BACKGROUND OF THE INVENTION

Prior to the disclosed invention it was difficult for a user of trousers to open the trousers with a single hand to urinate. Similarly, it was difficult to build trousers that rapidly adapted to the size of the user and existing pockets cannot adequately accommodate large items comfortably. The prior art includes: U.S. Pat. No. 4,164,044 issued to Holmes; U.S. Pat. No. 4,580,298 issued to Tuisl; and U.S. Pat. No. 4,677,699 issued to Barabe.

Barabe comprises a waist band that can be expanded or contracted simply using a hook and loop fastener. However, Barabe offers no theory about how a user can simply remove a flap to go to the bathroom without removing the trousers. Tusil teaches a waist band extender using a series of buttons on a perforated piece of materials but does not teach a hook and loop fastener, which is necessary for rapidly removing the flaps to accommodate large items. Holmes teaches an adjustable waist band in two sections with buttons and a perforated piece of material but does not teach a hook and loop fastener to enhance this device. In that manner, Holmes, Barabe and Tusil offer nothing to solve the problems described by the current invention.

BRIEF SUMMARY OF THE INVENTION

Trousers provide more comfort for a user than traditional pants. The trousers comprise widefly jeans mechanically coupled to belt loops which can accommodate a belt. The belt is mechanically coupled to buttons; the buttons can fit into button holes; the button holes are riveted in an adjustable waistband. In this manner the user can easily couple the adjustable waistband to the belt by inserting the buttons through the button holes. The adjustable waistband is mechanically coupled to a hook and loop fastener that is further mechanically coupled to a front flap with a front small cargo pocket that can provide additional storage for a wallet or armor made from Poly-paraphenylene terephthalamide—branded KEVLAR®. The user can easily open the widefly jeans with a single hand by simply uncoupling the adjustable waistband from flap belt and removing the front flap by uncoupling the hook and loop fastener. This enables the user to access an inside of widefly jeans with the single hand and close with one hand while another is occupied; like holding a weapon.

A comfort pocket is mechanically coupled to an inside of the widefly jeans. The comfort pocket provides a space for the user to rest testicles in such a way that regardless of motion the testicles will not be uncomfortably positioned within the widefly jeans. A front thigh cargo pocket has one riveted button at each cornet for additional locking support. There is a hook and loop fastener on both sides of the cargo pocket so that the user can easily access the cargo pocket while sitting. This is an improvement over traditional pants that are difficult to access pockets while sitting. Look and loop fasteners are mechanically coupled to four sides of a thigh cargo pocket locking in valuables and then adding a riveted button on each corner to have a wide opening.

BRIEF DESCRIPTION OF THE SEVERAL VIEWS OF THE DRAWINGS

Figure 1:
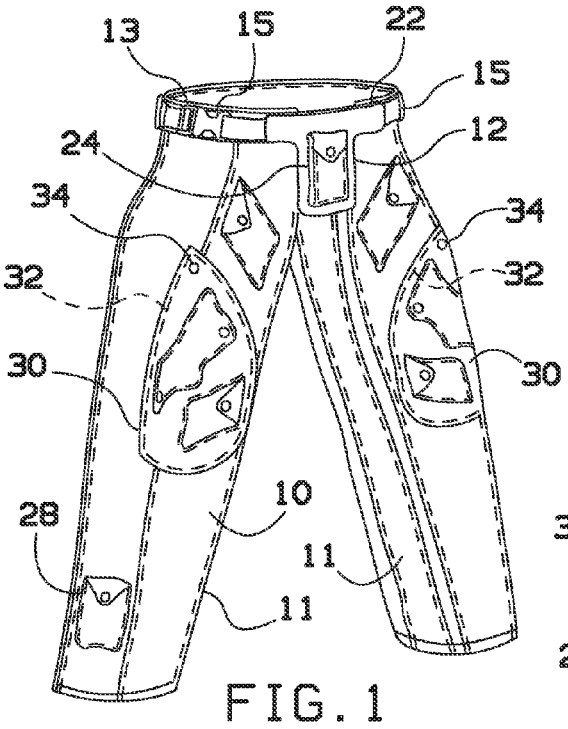

Having thus described the invention in general terms, reference will now be made to the accompanying drawings, which are not necessarily drawn to scale, and wherein:

FIG. 1 is a perspective view of the invention shown in use.

Figure 2:
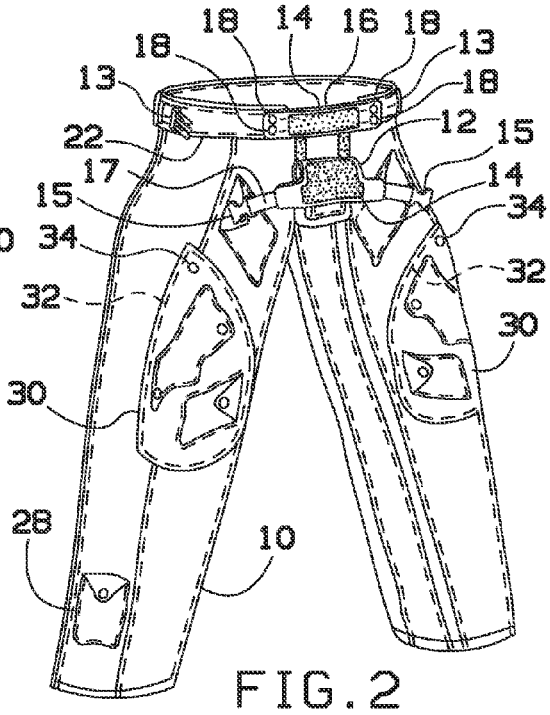

FIG. 2 is a perspective view of the invention shown in use with the front flap in the down position.

Figure 3:
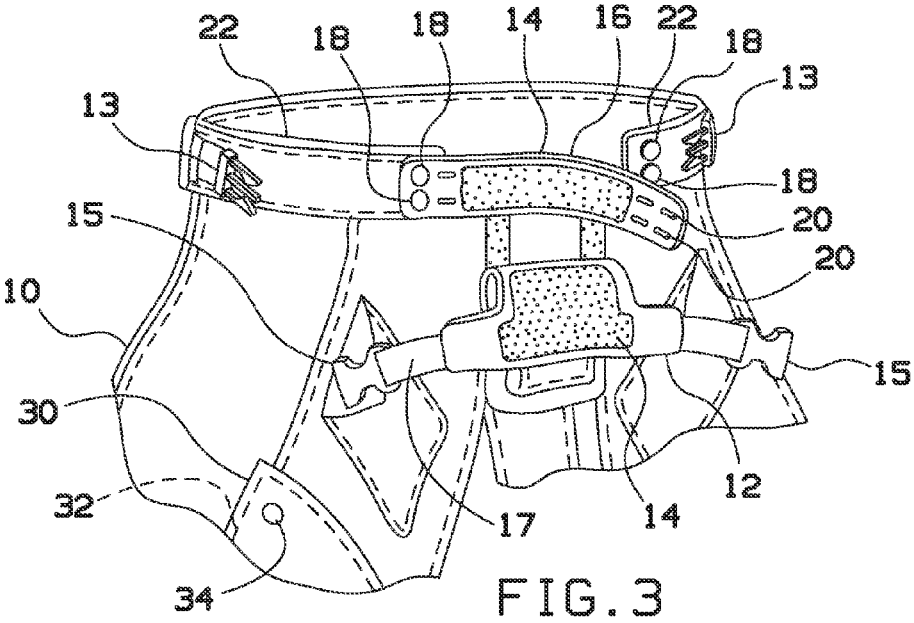

FIG. 3 is a detailed perspective view of the invention shown with the adjustable waist band in the open position.

Figure 4:
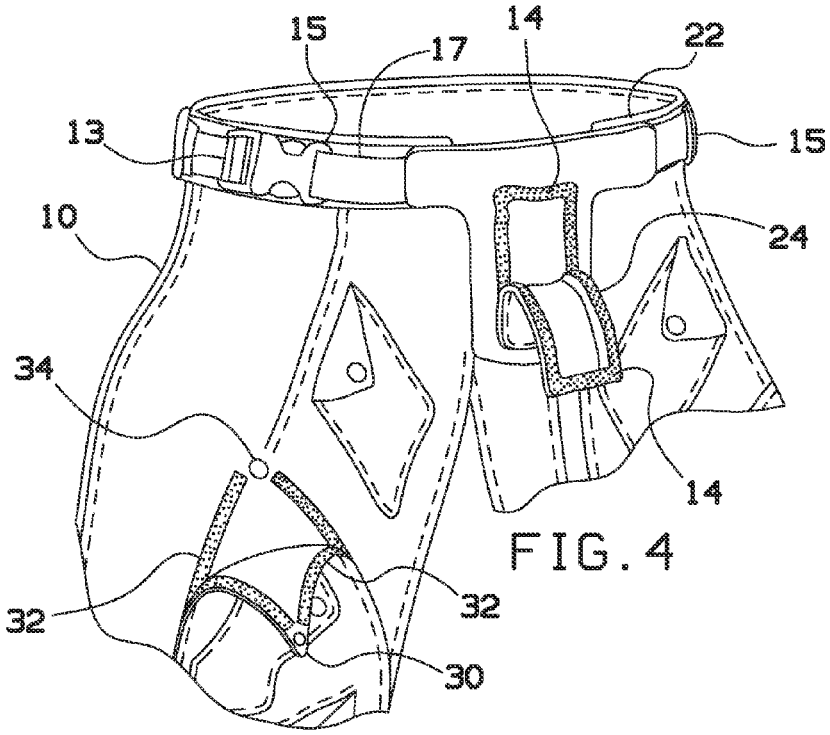

FIG. 4 is a detailed perspective view of the invention shown with the quick release flap in the open position.

Figure 5:
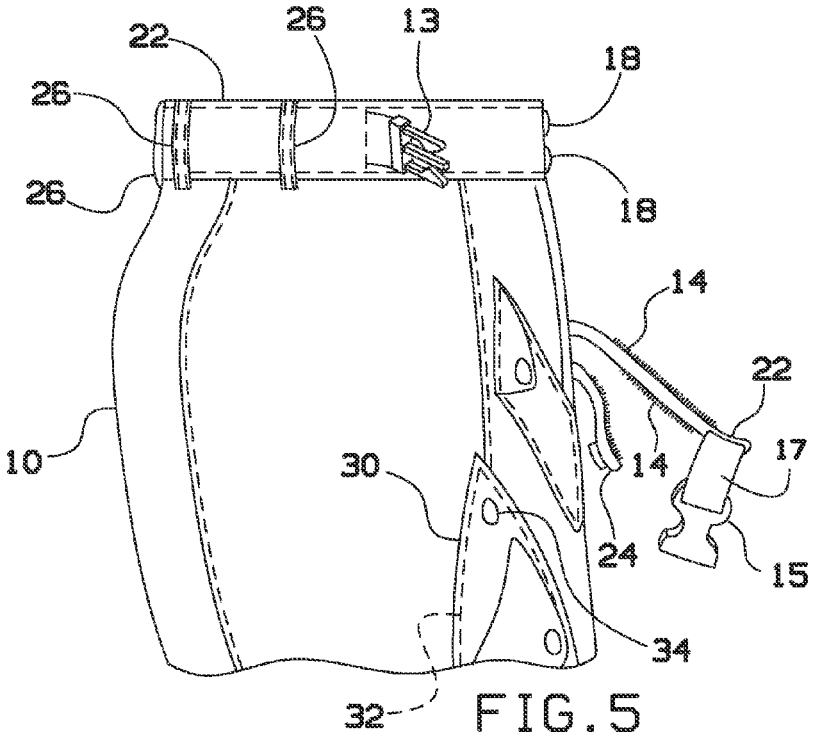

FIG. 5 is a detailed side view of the invention shown with the quick release flap and the front flap in the open position.

Figure 6:
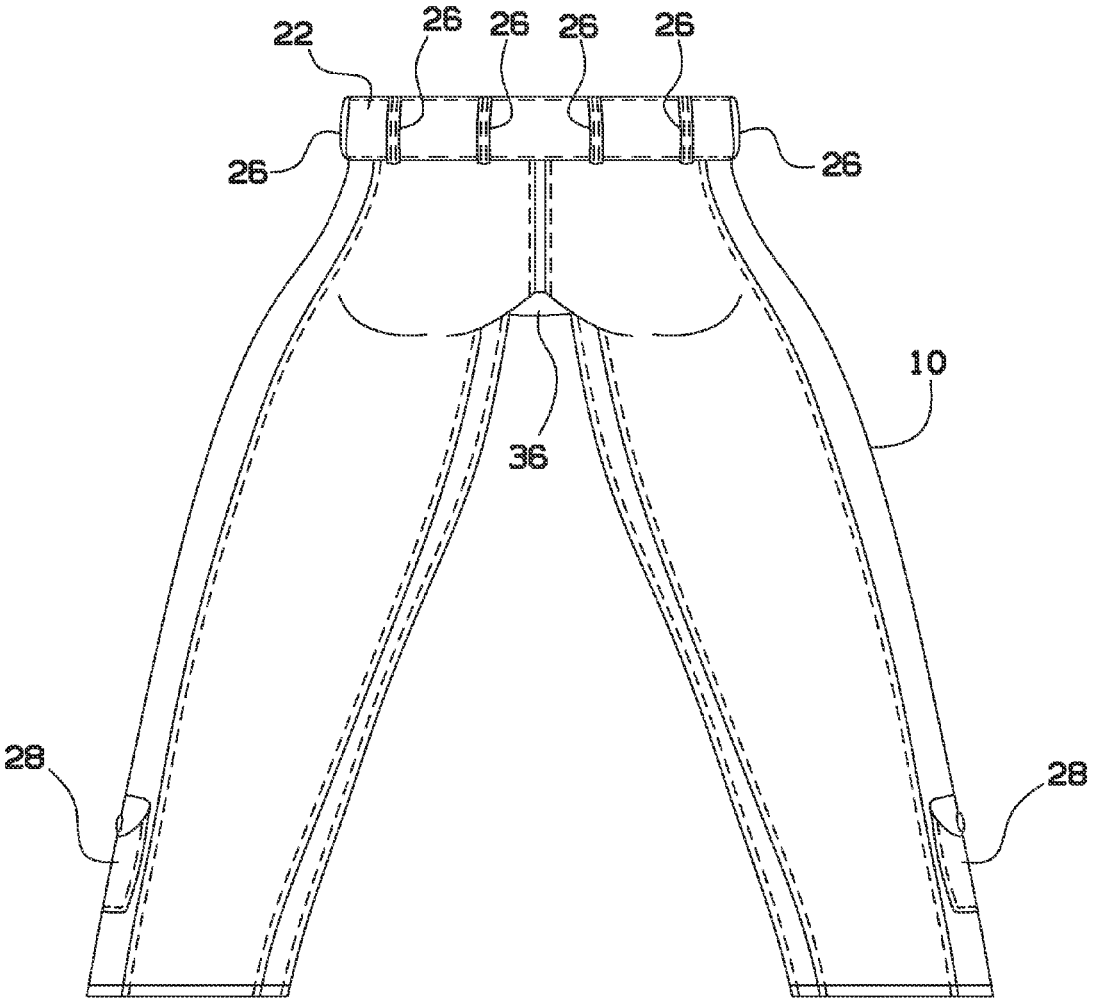

FIG. 6 is a back view of the invention.

Figure 7:
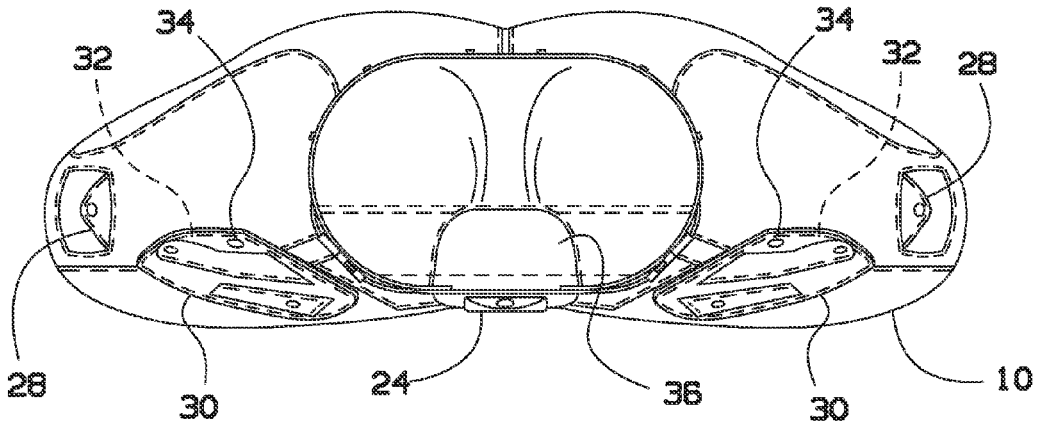

FIG. 7 is a top view of the invention.

Figure 8:
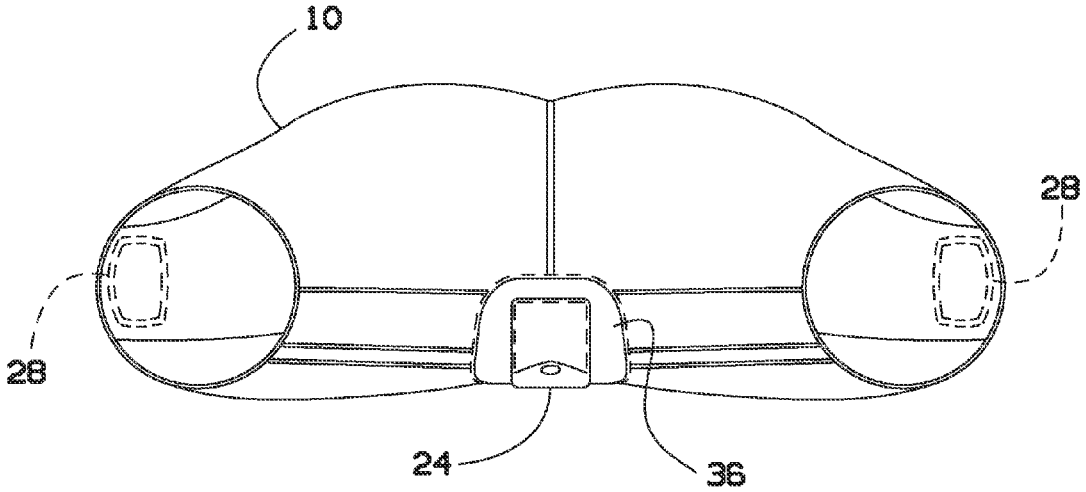

FIG. 8 is a bottom view of the invention.

DETAILED DESCRIPTION OF THE INVENTION

Embodiments of the present invention overcome many of the obstacles associated with wearing conventional trousers, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1 and FIG. 2 show the invention in use. Widefly jeans 10 comprise an internal belt further comprising first male fitting 13 and second male fitting 13. First male fitting 13 is mechanically coupled to first female fitting 15. In some embodiments, first male fitting 13 can be a first male slide release buckle component and first female fitting 15 can be a first female slide release buckle component. In concert, they can form a first slide release buckle. Likewise, second male fitting 13 is mechanically coupled to second female fitting 15. In some embodiments, second male fitting 13 can be a second male slide release buckle component and second female fitting 15 can be a second female slide release buckle component. In concert, they can form a second slide release buckle. There is a belt section 17 which travels from first female fitting 15 to second female fitting 15 is immediately adjacent to front flap 12. Front flap 12 is mechanically coupled to adjustable waistband 16 with buttons 18 and thus to belt 22 as shown in more detail in FIG. 3, FIG. 4, FIG. 5 and FIG. 6. Adjustable waistband 16 is mechanically coupled to hook and loop fastener 14 which can be mechanically coupled to hook and loop fastener 14. Hook and loop fastener 14 is mechanically coupled to front flap 12. However, front flap 12 is partially removable, and can be opened all the way to the back of the pants to the user's scrotum with comfort pocket 36 as shown in FIG. 7. This allows men to urinate without removing their pants simply by removing front flap 12 all the way to the back past their scrotum. Front flap 12 is mechanically coupled to front small cargo pocket 24. Opposite front flap 12 on the inside of widefly jeans 10 is comfort pocket 36 as shown in more detail in FIG. 6 and FIG. 7.

Widefly jeans 10 are further mechanically coupled to cargo pockets 30 by pocket hook and loop fastener 32 and pocket button 34 as shown in more detail in FIG. 4 and FIG. 5. Hook and loop fastener 32 can be similar to the material sold under the trademark VELCRO®. Widefly jeans 10 are also mechanically coupled to side pockets 28 as shown in FIG. 6, FIG. 7 and FIG. 8. Widefly jeans 10 further comprises inseam denim material 11 that is mechanically coupled to comfort pocket 36.

A novel feature of the present device is adjustable waistband 16. As shown in FIG. 3, FIG. 4, FIG. 5 and FIG. 6. Belt 22 is a fixed internal belt that does not slide through belt loops 26 as is well known in the art. Belt 22 is mechanically coupled to four buttons 18. Adjustable waistband 16 is perforated with button holes 20. In this manner a user can affix belt 22 to adjustable waistband 16 by inserting eight buttons 18 through button holes 20. A user can easily open widefly jeans 10 by simply uncoupling adjustable waistband 16 from belt 22 and removing front flap 12 by uncoupling hook and loop fastener 14. This enables a user to access the inside of widefly jeans 10 with a single hand. This allows a user to easily adapt widefly jeans 10 to fit a user's unique body shape.

Another novel feature is comfort pocket 36. As shown in FIG. 6 and FIG. 7, comfort pocket 36 is mechanically coupled to front flap 12. Comfort pocket 36 provides a space for a user to rest one's testicles in such a way that regardless of motion the testicles will not be uncomfortably position within widefly jeans 10. Further, inseam denim material 11 has advantages over a traditional seam that separates a user's scrotum. This contradicts a common problem for men, that is, sitting down in pants inevitably results in testicles being compressed in an uncomfortable manner. The present invention suspends the testicles in a stationary pocket resolving that problem.

Partially removable pocket that is affixed to widefly jeans 10, which allows the insertion of larger items such as padding, armor, a map or another large item. The attachment of cargo pockets 30 to widefly jeans 10 utilizes pocket hook and loop fastener 32 for approximately 75% of the length of cargo pockets 30 and sewing for the remainder of cargo pockets 30. Cargo pockets are further affixed to widefly jeans 10 by pocket button 34. Holmes, Tuisl, and Barabe offer no theory on how to make partially removable pockets or how partially removable pockets would be advantageous. Partially removable pockets are advantageous because they give the user an option to carry more material. To contrast, side pockets 28 provide some permanent storage.

As with most jeans, widefly jeans 10 are preferably made from denim or dungaree cloth as those are strong durable materials. The remaining components can be affixed with sewing and thread which are known in the field.

Widefly jeans 10 provide more comfort for a user than traditional pants. In the preferred embodiment, widefly jeans 10 further comprise belt 22 which is a stitched in thick belt material. The ability to internally adjust belt 22 creates an adjustable waistband that gives the user the option to adjust the waistband. For instance, if one loses couple of pounds in the battlefield one could adjust the adjustable waistband one can simply adjust the waistband. Further, widefly jeans 10 comprise an internal belt that readily affixes the internal belt to the external front flap 12 using male fasteners 13 and female fasteners 15. Widefly jeans 10 further comprise stitched in eight button holes 20 on belt 22 that are fastened by riveted stainless steel buttons 18. Widefly jeans 10 further comprise front flap 12 which accommodates front pocket 24 that can hold the user's wallet, or armor made from Poly-paraphenylene terephthalamide—branded KEVLAR®. Further, front flap 12 is a quick release flap for convenience going to the restroom at any time anywhere any place is by using one hand while holding may say a weapon while in combat he could easily flip front flap 12 back up by using one hand because it is held by hook and loop fastener 32. In another embodiment, front flap 12 can be mechanically coupled to widefly jeans 10 with a zipper on either side of front flap 12 or with a hook and loop fastener in place of the zipper.

That which is claimed:

1. Trousers configured to provide more comfort for a human user than traditional pants, the trousers comprising;

widefly jeans comprising a belt having a first male side release buckle component at a first end and a second male side release buckle component at a second end; buttons, mechanically coupled to a first front portion and a second front portion of the widefly jeans;

a belt section mechanically coupled to a first female side release buckle component and a second female side release buckle component at respective ends of the belt section; wherein the male; side release buckle components and the female; side release buckle components are configured to be mated detachably coupling the belt section to the belt;

an adjustable waistband, further comprising a first plurality of button slots at a first end of the adjustable waistband and a second plurality of button slots at a second end of the adjustable waistband; wherein each button is able to operatively engage with more than one button slot in order to adjust the adjustable waistband; the adjustable waistband is mechanically coupled to a hook and loop fastener that is further mechanically coupled to a front flap; wherein the front flap extends from the adjustable waistband to behind a midpoint from a bottom perspective of the widefly jeans and is configured to accommodate the human a user's scrotum;

a cargo pocket directly coupled to a front side of the front flap; the cargo pocket configured to accommodate a wallet;

wherein the widefly jeans are configured to be opened with a single hand by simply uncoupling the adjustable waistband from the widefly jeans and removing the front flap by uncoupling the hook and loop fastener;

wherein the widefly jeans are configured to permit the human user to access an inside of the widefly jeans with the single hand and to urinate without removing the trousers.

2. The trousers of claim 1, further comprising, the widefly jeans are mechanically coupled to belt loops which can accommodate the belt.

3. The trousers of claim 1, further comprising, a comfort pocket that is mechanically coupled to a back side of the front flap; the comfort pocket having a cavity configured to lift and support human testicles wherein regardless of motion the testicles will remain in a central portion of the widefly jeans.

4. The trousers of claim 1, further comprising, partially removable pockets comprising cargo pockets partially affixed to the widefly jeans with a pocket hook and loop fastener; and partially affixed to the widefly jeans using sewing; the cargo pockets are further mechanically coupled to a pocket button which can hold a partially removable pocket in place; the partially removable pockets are advantageous because they give the user an ability to open the partially removable pocket while seated.

* * * * *